US007764020B2

(12) United States Patent
Barnett

(10) Patent No.: US 7,764,020 B2
(45) Date of Patent: Jul. 27, 2010

(54) ELECTRO-PERMANENT MAGNET FOR POWER MICROWAVE TUBES

(76) Inventor: Larry R. Barnett, 420 Red Hill Rd., Normandy, TN (US) 37360

( * ) Notice: Subject to any disclaimer, the term of this patent is extended or adjusted under 35 U.S.C. 154(b) by 415 days.

(21) Appl. No.: 11/779,261

(22) Filed: Jul. 17, 2007

(65) Prior Publication Data

US 2008/0018255 A1 Jan. 24, 2008

Related U.S. Application Data

(60) Provisional application No. 60/807,849, filed on Jul. 20, 2006.

(51) Int. Cl.
*H01J 23/08* (2006.01)

(52) U.S. Cl. ..... 315/5.35; 315/5.16; 315/5.37; 315/5.43

(58) Field of Classification Search ..... 315/1, 315/3, 5.14, 5.16, 5.35, 5.37, 5.43, 8.51
See application file for complete search history.

(56) References Cited

U.S. PATENT DOCUMENTS 3,488,550 A * 1/1970 Oltman, Jr. ..... 315/5.44
3,832,596 A 8/1974 Nelson et al.
4,395,655 A * 7/1983 Wurthman ..... 315/4
4,555,646 A * 11/1985 Miram et al. ..... 315/5.35
5,233,269 A * 8/1993 Lien ..... 315/5.37
5,550,432 A * 8/1996 Barker ..... 315/5
5,576,679 A 11/1996 Ohashi et al.
5,610,482 A 3/1997 Dumbrajs et al.
5,818,170 A 10/1998 Kikunaga
5,828,173 A 10/1998 Mobius et al.
6,768,265 B1 * 7/2004 Ives et al. ..... 315/5.16
6,847,168 B1 * 1/2005 Ives et al. ..... 315/5.14

* cited by examiner

*Primary Examiner*—Douglas W Owens
*Assistant Examiner*—Tung X Le
(74) *Attorney, Agent, or Firm*—Louis Ventre, Jr.

(57) ABSTRACT

A magnet configuration for a power microwave tube with a resonant cavity comprises a permanent magnet (110) with an axis-aligned through-bore (135) of sufficient size to contain the resonant cavity. The permanent magnet has an inner chamber (140) that is centered on the axis (130) with opposite magnet poles aligned along the axis. The magnet configuration further comprises an electromagnet coil (120) fitting in the chamber and encircling the axis such that the coil produces a magnetic field that reinforces the magnetic field from the permanent magnet. An optional protrusion (125) spanning the through-bore narrows an air gap between the poles. The method provides a magnetic field in a power microwave generator by combining a permanent magnet with an electromagnet in accordance with the magnet configuration and energizes the electromagnetic coil, which may be by pulsing the coil current.

13 Claims, 5 Drawing Sheets

ELECTRO-PERMANENT MAGNET FOR POWER MICROWAVE TUBES

CROSS-REFERENCE TO RELATED APPLICATION

The present invention claims the benefit of the filing date of prior U.S. provisional application 60/807,849 filed 20 Jul. 2006, the text of which is included by reference herein.

FIELD OF INVENTION

In the field of power microwave tubes, a combination permanent magnet and electromagnet in a configuration that produces a through-bore magnetic field significantly greater than the fields from similar individual magnets.

BACKGROUND OF THE INVENTION

Power microwave tubes use magnetic flux to emit microwave radiation. The invention has application in magnets for gyrotron, peniotron tubes and other types of high frequency microwave tubes that require very high magnetic fields, such as millimeter and submillimeter wave traveling-wave tubes, backward wave oscillators, carcinotrons, and others. In this application, reference to "power microwave tubes" is intended to be broadly defined to include: (1) high frequency microwave tubes of varying types and interactions; and, (2) microwave generators, especially those that would benefit from higher magnetic fields. Gyrotrons and peniotrons, with their microwave cavities, are used as examples herein, but it should be understood that principles discussed apply the larger spectrum of power microwave tubes as defined above.

A gyrotron gyrates the path of a stream of electrons flowing through a cavity in a strong magnetic field and, by doing so, imparts electrons with cyclotron motion while emitting a millimeter wave beam. Essentially, microwaves are generated by maser effects of cyclotron resonance. A peniotron uses the energy exchange between gyrating electrons and a high frequency electromagnetic field structure to generate microwaves. Gyrotrons and peniotrons are high powered electron tubes that convert electron kinetic energy to microwave radiation using a magnetic field.

High-power microwave tubes above 30 gigahertz frequently employ, and gyrotrons almost exclusively employ, a superconducting magnet system. Major problems with current technology employing a superconducting magnet system reside in the weight of the magnet system and its attendant refrigeration equipment, its contribution to cost and reliability, the continuous power it consumes, and the cool-down time prior to initial operation. Superconducting magnets are expensive and difficult to transport, operate and maintain outside a controlled environment, such as in a laboratory or fixed industrial installation.

The present invention provides (1) a permanent magnet having a magnetic flux density exciting a large air gap; (2) an electromagnet having a magnetic flux density exciting the same large air gap; and, (3) a though-bore for the insertion of a microwave tube through the magnet. The combination under the specified configuration yields a magnetic flux density significantly larger in the large air gap than the air gap flux densities from either magnet operating alone. Under certain conditions, such as when incorporating non-linear magnetic materials, the resultant magnetic field can be even significantly larger than the sum of the fields of the individual magnets. As referred to herein, the air gap is the distance though the air from one pole to the other of a magnet having a through-bore.

This combination of electromagnet or solenoid and permanent magnet in the specified configuration is termed an electropermagnet. The import of the electropermagnet is that it is a very powerful magnet that may be employed in power microwave tubes that exploit an optimum magnetic-field-strength, or cyclotron harmonic number, thus avoiding the need for superconducting electromagnets.

A magnet for a power microwave tube must be extremely stable or the device will be detuned, jump to inefficient modes, or not even work at all. This has been a key problem area for magnets used for power microwave applications. The electropermagnet of the current invention provides a magnet with a highly constant field that is also tunable over a large temperature variation.

In addition, the invention adds versatility in that it provides a high magnetic field when using magnetic materials with either a high coercive force or a low coercive force. The coercive force is the amount of reverse magnetic field which must be applied to a magnetic material to make the magnetic flux return to zero.

The coercive force is a property or type of the material comprising the permanent magnet for which a continuum of high to low coercive force material is possible. The invention applies to the continuum, but is described herein for convenience and to facilitate description of the invention in terms of high-coercive force or low-coercive force materials. For both of these types of materials, the invention also yields desirable characteristics of higher temperature tolerance, ruggedness, and lower cost.

The present invention helps to solve the above-identified problems by eliminating the need for a superconducting magnet system in power microwave tubes.

DESCRIPTION OF PRIOR ART

Permanent magnets and electromagnets are known to be used in gyrotrons and other tubes. No prior art teaches or suggests a combination of a permanent magnet and an electromagnet in a configuration that can produce a magnet field significantly greater than the individual magnetic fields of the permanent magnet and the electromagnet. None proposes, or even suggests, that an unusually powerful through-bore field can be produced by using both a permanent magnet and an electromagnet in an optimal way.

For example, U.S. Pat. No. 5,610,482 discloses a gyrotron comprising in part an arrangement disposed around the resonator which generates a solenoidal, static, axial, magnetic constant field. It also teaches obtaining magnetic field continuity by additional winding arrangements in the area of the resonator or by appropriately guiding the magnetic flux by means of iron structures. The '482 patent teaches that a combined structure of electromagnets and permanent magnets may be advantageous. But the electromagnetic coil of the '482 patent is utilized as a "trim coil" for the purpose of making small adjustments to the permanent magnet field and not for the functions in the present invention. The '482 patent in no way suggests a configuration where the electromagnetic coil is within a chamber of a permanent magnet, nor does it teach that any such combination yields a magnetic field significantly greater than the magnetic fields, or greater than the sum of the magnetic fields, from the individual magnets.

The invention compares very favorably to gyrotrons using existing superconducting and electromagnet designs, which require about 3 to 5 times the diameter and length and about 10 to 25 times the volume and weight to produce that same volume and strength of magnetic field.

The present invention provides a magnetic system comparatively light weight and very safe to assemble. An example of existing technology that can be quite heavy and dangerous to assemble is U.S. Pat. No. 5,576,679, which teaches a cylindrical permanent magnet unit suitable for application to gyrotrons. Between two cylindrical magnets are coaxially juxtaposed assembly of a plurality of ring-like permanent magnets, and each ring-like magnet is constructed of a plurality of permanent magnet segments.

Devices using only permanent magnet materials of the present technology can typically produce significant volume fields up to about a 10 kilogauss axial field, and weigh in many hundreds of kilograms compared to the present invention that might weigh about 10-20 kilograms and produce twice as much magnetic flux density (e.g. about 20 kilogauss) on axis.

Additionally, the present invention may be unmagnetized when assembled and self-charged after assembly using its own internal electromagnet coils. In comparison, magnets in conventional systems are usually precharged and can often have repulsion and attraction forces approaching many tons. Thus, assembly requires massive machines to hold the pieces while being put together and clamped in place. It is often dangerous because the forces can expel pieces at high velocities.

Accordingly, the present invention will serve to improve the state of the art by providing a new and innovative magnet combination and the method of using the magnet combination in power microwave tube applications. For these applications, the present invention significantly reduces the weight of the magnet system and the cost of the magnet components, increases reliability of the power microwave tube, provides higher temperature tolerance, increases safety in assembly, adds ruggedness, and eliminates superconducting cool-down time prior to initial operation. The present invention accomplishes these solutions by providing a magnetic field in an electropermagnet that is capable of achieving a high magnetic field that can replace a superconducting magnet system.

BRIEF SUMMARY OF THE INVENTION

A magnet configuration for a power microwave tube with a resonant cavity comprises a permanent magnet with an axis-aligned through-bore of sufficient size to contain the resonant cavity. The magnet configuration produces a very high magnetic flux density within the through-bore. The permanent magnet has an inner chamber that is centered on the axis with opposite magnet poles aligned along the axis. The magnet configuration further comprises an electromagnet coil fitting in the chamber and encircling the axis such that the coil produces a magnetic field that reinforces the magnetic field along the axis from the permanent magnet. An optional protrusion spanning the through-bore narrows an air gap between the poles. The method provides a magnetic field in a power microwave generator by combining a permanent magnet with an electromagnet in accordance with the magnet configuration and energizes the electromagnetic coil with a constant or pulsing coil current.

BRIEF DESCRIPTION OF THE DRAWINGS

Referring now to the drawings in which like reference numbers represent corresponding parts throughout.

DETAILED DESCRIPTION

In the following description, reference is made to the accompanying drawings, which form a part hereof and which illustrate several embodiments of the present invention. The drawings and the preferred embodiments of the invention are presented with the understanding that the present invention is susceptible of embodiments in many different forms and, therefore, other embodiments may be utilized and structural and operational changes may be made without departing from the scope of the present invention.

Figure 1:
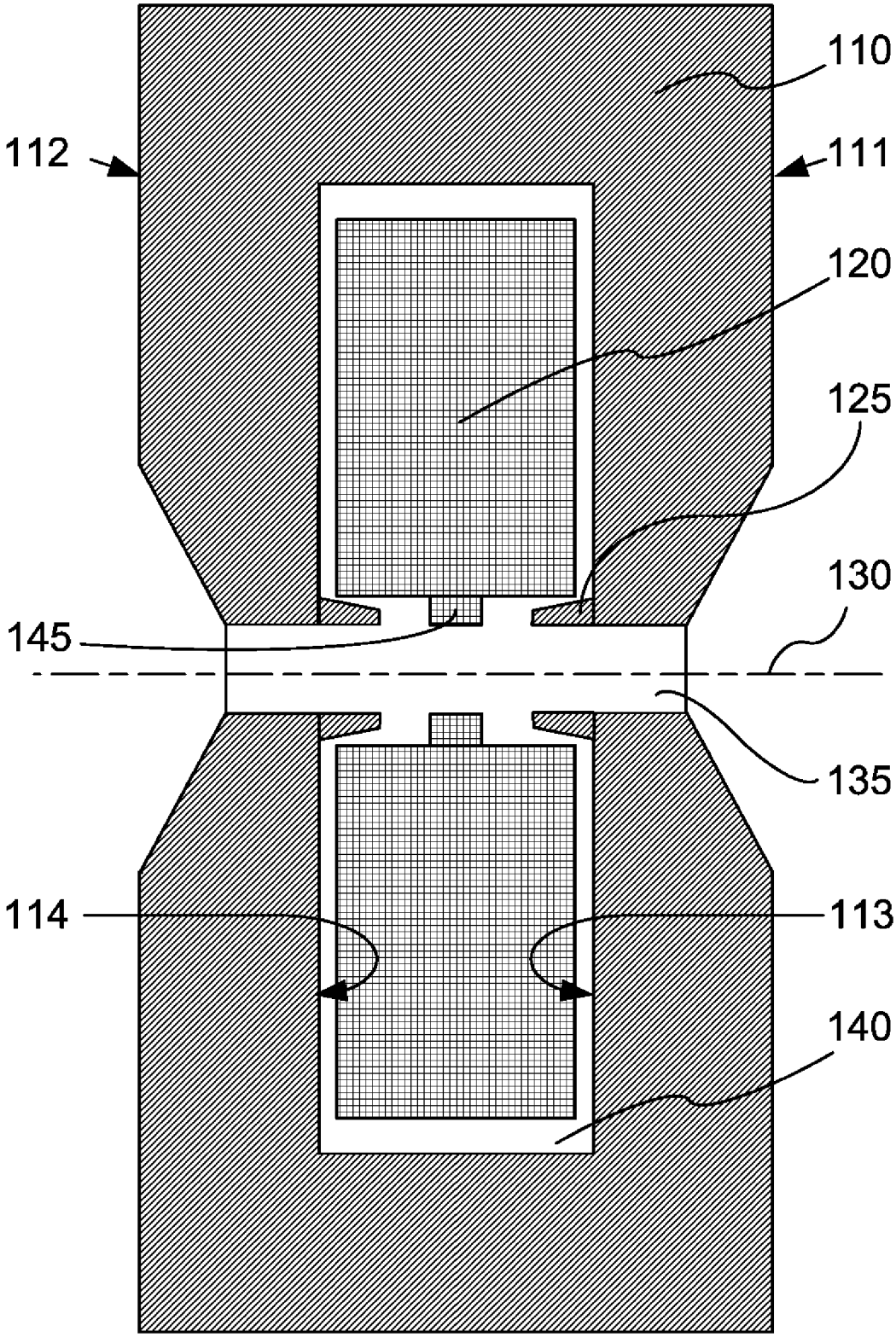
FIG. 1 a cross section of the electropermagnet in an embodiment of the invention.

FIG. 1 is an illustration of an embodiment of the invention in a configuration for a gyrotron. It is a cross-sectional view of this embodiment in the configuration for a power microwave tube having a resonant cavity.

Figure 3:
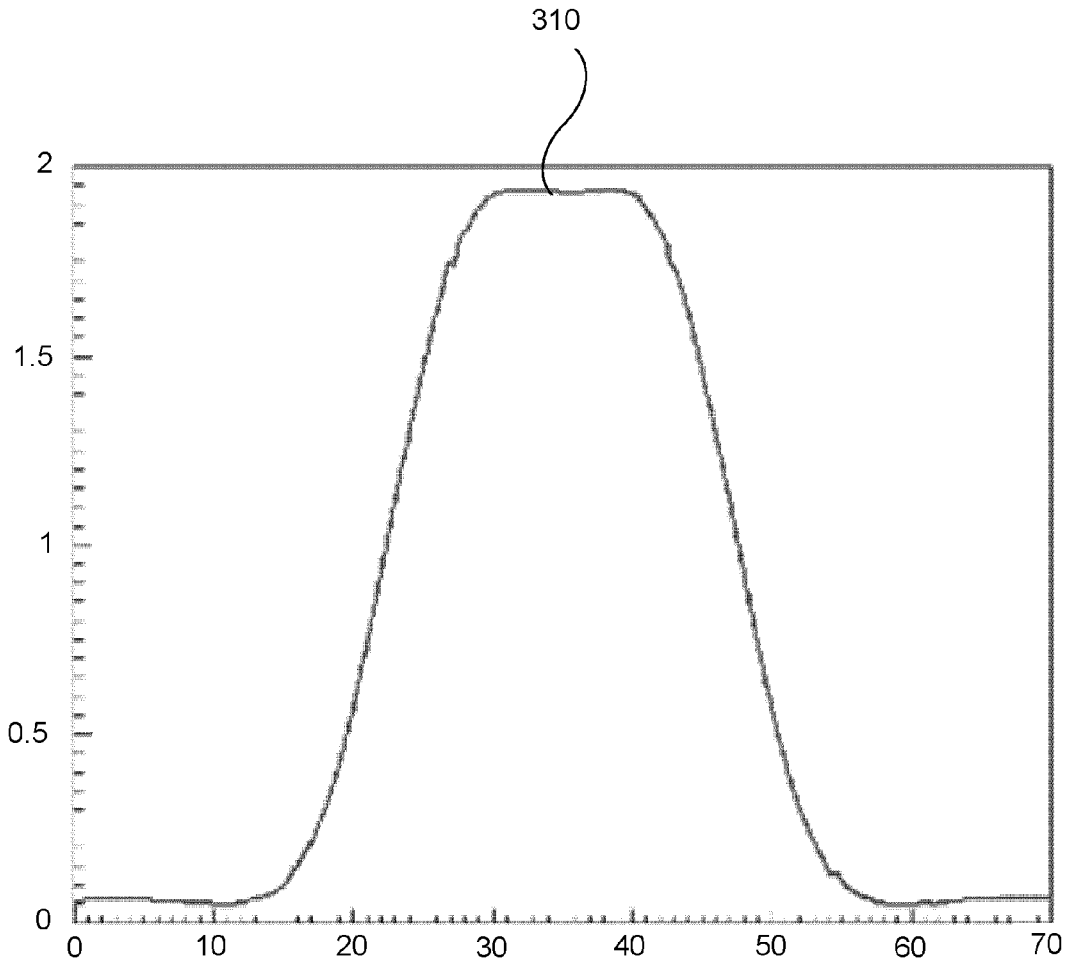
FIG. 3 is a plot of the magnetic flux density on the axis of the electropermagnet of a linear magnetic material.

Correspondingly, FIG. 3 plots the magnetic flux density, B, in Teslas on the vertical axis against millimeters of this embodiment.

The electropermagnet design and flux density plot are based on a calculation (using the MAXWELL software by ANSOFT CORPORATION) for a gyrotron configuration electropermagnet. This is an axi- symmetric geometry. The permanent magnet material is Neodymium Iron Boron 35 (NIB) with a residual magnetic flux density, $B_r$, equal to 12.5 kilogauss. The dimensions used for the calculation and plotted on the horizontal axis in FIG. 3 are in millimeters with a 10 millimeter inside-diameter through-bore (135) and an outside diameter of 13 centimeters.

The invention is not limited by using a permanent magnet with any specific through-bore magnetic flux density, through-bore hole diameter, outside diameter or length along the axis. Thought to be practical for the vast majority of applications are through-bore magnetic flux densities up to about 24 kilogauss, through-bores up to about 25 millimeters in diameter, outside diameters up to about 30 centimeters, and lengths along the axis up to about 30 centimeters.

With reference to FIG. 1, the permanent magnet (110) is in the shape of a right circular cylinder having ends (111 and 112) in approximate parallel planes. This shape was selected for the examples given for ease of calculation modeling. The permanent magnet may have any solid shape and the ends may or may not be in parallel planes. For example instead of a rectangular cross-section, it may be circular, oval, square, or any irregular shape. The invention is not limited to a permanent magnet in the shape of a right circular cylinder, because the principles of the invention apply to any such shape, which may be selectively chosen, for example, to alter the magnetic field.

A through-bore (135) is approximately centered on an axis (130) between the ends (111 and 112) of the permanent magnet (110), wherein the through-bore (135) is of sufficient size to contain the resonant cavity.

The diameter and length of the through-bore (135) are not limited to any particular dimensions. For purposes of example, through-bore diameters of 10-14 millimeters have been designed for an electropermagnet for gyrotrons requiring 18 kilogauss in up to a 2.2 centimeters-long-high-field-region length, with only 150 millimeters in outside diameter and 70 millimeters in overall axial length. Generally speaking, a larger through-bore, for a given high-field-region length (as defined by a microwave tube interaction cavity requirement), increases the overall size of the magnet, and it is preferred to have a relatively small thru-bore in order to maintain small size and small power consumption of the magnet compared to current magnets in use.

An inner chamber (140) of the example shown in FIG. 1 has an approximate rectangular cross-sectional shape and is centered on the axis (130). The invention is not limited to an inner chamber with a rectangular cross-sectional shape, but includes any shape chamber that may be defined within the permanent magnet, wherein the chamber wall at opposing ends of the axis (130) forms opposite magnetic poles (113 and 114).

In an alternative embodiment, the chamber has a circumferential protrusion (125) spanning the through-bore (135) and extending inward from the chamber wall. The protrusion (125) creates a narrowed chamber around the through-bore. The end of the protrusion at opposing ends of the axis (130) also forms opposite magnetic poles. The distance between the end of the protrusion at the opposing ends of the axis (130) is termed the air gap.

An electromagnet coil (120), or a plurality of electromagnetic coils, fits within the chamber (140) and encircles the axis (130) such that, when electrically energized, the coil (120) produces a magnetic field that reinforces the magnetic field from the permanent magnet (110). A small trim coil (145) may be used, and other coils may be added, to shape the magnetic field as desired.

For the calculation of the design and magnetic flux density, the electromagnet coil (120) within the permanent magnet material (110) is equivalent to 42,000 Ampere-turns, a power density that can be handled by water cooled solenoids, and will take an estimated 2 kilowatts of direct current power.

FIG. 3 plots the calculated magnetic field of a 1.93 Tesla electropermagnet of the configuration of FIG. 1 with a through-bore (135) using NIB as the permanent magnet (110) material and having a residual magnetic flux density, $B_r$, equal to 1.25 Tesla. The top part of the plot (310) shows the flat field region that lies on the axis (130). For a gyrotron application, low field coils on the outside of the electropermagnet would also typically be used at each end incident to the outside electron gun and collector fields.

Figure 2:
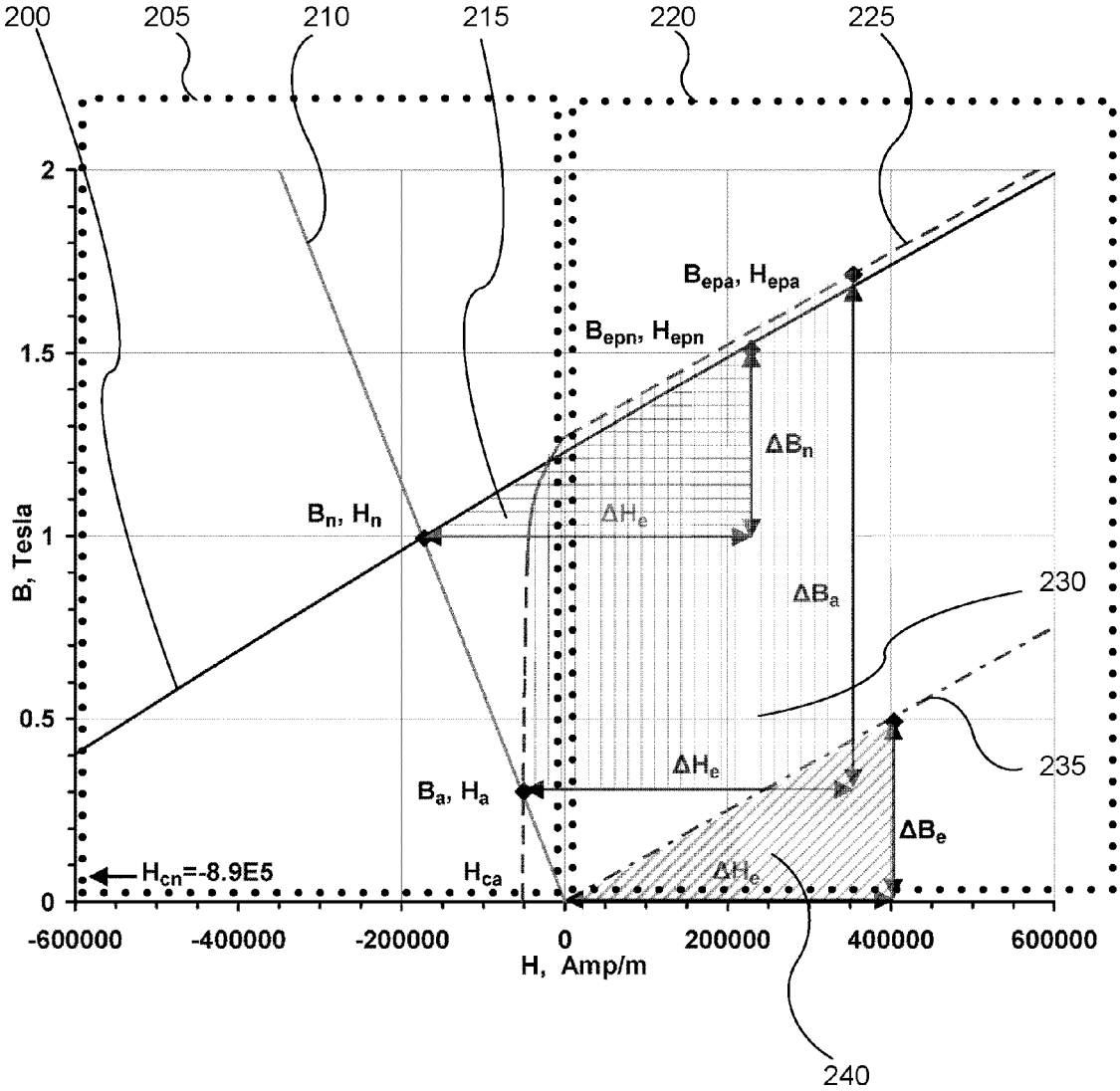
FIG. 2 is a plot illustrating principles of the invention for both linear and nonlinear magnetic materials.

For an explanation of the principles of the electropermagnet, reference is made to FIG. 2, which plots magnetic flux density, B, on the vertical axis against magnetic field strength, H, in amperes per meter at a point in permanent magnet material near an air gap. Shown is a curve for a typical linear magnetic material, Neodymium Iron Boron (NIB), over a usual operating range. The NIB curve (200) is approximately a straight line. Another example of a linear magnetic material is Samarium Cobalt.

Also shown in FIG. 2 is a curve for a typical nonlinear magnetic material, Aluminum Nickel Cobalt (Alnico5), over the operating range. The Alnico5 curve (225) is highly curved, that is, it has a non-linear shape. For purposes of this invention, a permanent magnetic material that has an approximate linear curve within its operating range is defined as having a linear property, and one that has a non-linear curve within its operating range is defined as having a non-linear property. Typically, a low coercive force magnetic material is non-linear in the operating range for cases of useful large air gaps. Typically, a high coercive force magnetic material is linear over its operating range, but it can also be non-linear.

Whether the property of a magnetic material is linear or non-linear can be important in many applications. For example, the resultant magnetic field from a preferred embodiment of the invention using a magnetic material having a non-linear property within the typical operating range is significantly larger than the sum of the fields of the permanent magnet and the electromagnet. This resultant magnetic field allows for the use of non-linear, or low coercive force, magnetic materials, which in turn permits use of lower cost and/or higher temperature tolerant magnetic materials to be utilized.

Envision a point in a magnetizable material that is not charged (B=H=0). When magnetizing field strength, H, is applied (e.g. an electromagnet coil around one leg of a closed loop of the material) the magnetic flux density, B, increases in the first quadrant (220) until the material saturates. When the magnetizing field strength, H, is continued to be increased, the slope of the curve continues to increase at the rate of the permeability of free space, $\mu_0$. When the magnetizing field strength, H, is then decreased, the curve follows the path at which when magnetizing field strength, H, is again zero then the material has a residual magnetic field of flux density, $+B_r$, or the material is "charged." The curves in FIG. 2 represent magnetic material that is charged, where the charging curve is not shown for simplicity of the figure to explain the electropermagnet operating principles.

When magnetizing field strength, H, is applied in the opposite direction in the second quadrant (205), then B is eventually forced to zero at a magnetizing field strength, H, having a magnitude value designated $H_c$, called the coercive force. If the magnetizing field strength, H, is continued to be negatively increased, then the material is charged in the opposite direction to establish negative magnetic fields (the two negative B quadrants are not shown in FIG. 1 as they are symmetrical to the two positive B quadrants above the horizontal axis).

When there is an air gap in a permanent magnet material having a zero externally applied magnetic field strength, H, the permanent magnet material is operating in the second quadrant (205) in demagnetizing mode. In the second quadrant (205) demagnetizing mode, the permanent magnet material has an equivalent gap demagnetization field strength, $H_d$, and the magnetic field, B, has a demagnetizing flux density, $B_d$. A straight line from that point ($B_d$, $H_d$) to zero defines the gap operating line where ratio of the demagnetizing flux density over the demagnetizing field strength, $B_d/H_d$, is the air gap permeance coefficient. The air gap permeance coefficient is a function of the gap geometry at that point, is independent of the particular magnetic material, and is an indication of the relative ease with which magnetic flux passes through the air gap.

The point at which this air gap line (210) crosses a material's B—H curve, is given by a specific magnetic flux density, B, and magnetizing field strength, H. With a nonlinear material, there is also large flux leakage. Flux leakage is that portion of the magnetic flux that does not pass through the working air gap.

The coercive force, that is the demagnetizing field strength, is indicated at the point where the B—H curve for a material crosses the zero magnetic flux density line (B=0). This point is designated $H_c$. The higher the coercive force, $H_c$, the less the magnet self demagnetizes due to flux leakage. For the example in FIG. 2, compare an Alnico5 material curve (225) to Neodymium Iron Boron 35 (NIB) curve (200) with both having about the same residual flux density, $B_r$. However, the effect of the coercive force of Alnico5, $H_n$, on the air gap line (210) is much less than the effect of the coercive force of NIB, $H_n$ on the air gap line (210). Therefore, the flux leakage and demagnetization is much larger for Alnico5. For a given geometry with large air gap, the B field of the Alnico5 at the point will be much less than for the NIB.

The product of the residual flux density, $B_r$, times the coercive force, $H_c$, (in energy units) is a figure of merit of the strength of the material to produce a field in an air gap. To calculate useful configurations accurately requires a simulation code using thousands of cells/points.

The principle of the electropermagnet is to operate in the first quadrant (220), namely the magnetizing quadrant, wherein the magnetic material is saturated with magnetic flux. In this first quadrant (220), the magnetic flux density, B, increases approximately linearly (for most materials of interest) at the rate of the permeability of free space, $\mu_0$. Thus, the magnetic flux density, B, is approximately equal to the permeability of free space, $\mu_0$, times the magnetic field strength, H, plus the residual magnetic field strength, or $B \sim \mu_0 H + B_r$. Therefore, for a given desired magnetic flux density, B, with no (or very small) air gap, the magnetizing force required by the electromagnet is approximately reduced the residual magnetic flux density, $B_r$, divided by the permeability of free space, $\mu_0$, or an amount approximately equal to $B_r/\mu_0$.

If there is a large air gap, how much the required magnetizing force of the electromagnet (and coil current) is reduced (if at all) to create a particular magnetic field in the gap is not obvious. A closer inspection of magnetic flux density versus magnetizing force (proportional to coil current) in a large gap with various materials helps to explain the importance of the invention. It is significant that there will not be a material discharging problem by the electromagnet in the invention because the electropermagnet is being operated in the first quadrant (220), that is the magnetizing quadrant, of the material, not the second quadrant (205), that is the demagnetizing quadrant, as do most magnetic devices.

Because of first quadrant (220) operation of the electropermagnet, it is not necessary to use a permanent magnet material with high coercive force to obtain high electropermagnetic fields. Thus, simulations show that ordinary Alnico5, with low coercive force, works nearly as well as NIB with high coercive force. Ability to use low coercive force permanent magnet materials, such as Alnico5, is an important newly discovered attribute of the invention. That these two vastly different permanent magnet materials work comparably well is exemplified by the two cases plotted in FIGS. 2, 3, 4, and 5.

The first case is illustrated with the H—B NIB curve (200), which is illustrative of magnetic materials that are linear (or nearly linear) in the operating range of the first quadrant (220) and the second quadrant (205) and have permeability, $\mu$, approximately equal to the permeability of free space, $\mu_0$, or stated in an equation: $\mu \sim \mu_0$.

Another example for this first case of magnetic materials that are nearly linear is Samarium Cobalt (SmCo).

The second case is illustrated with the H—B Alnico5 curve (225), which is illustrative of magnetic materials that are nonlinear in the operating range of the first and second quadrants.

Regarding the first case, the H—B NIB curve (200) at its intersection with the air gap line (210) is point $B_n$, $H_n$, which signifies a demagnetizing field strength, $H_d$, at a point in the material near the gap is equal to $H_n$ and the demagnetic flux density, $B_d$, at that point is equal to $B_n$.

The point where the H—B NIB curve (200) crosses the H=0 line is the residual magnetic flux density, $B_r$. Note that magnetic flux density, B, drops very slowly on the H—B NIB curve (200) from $B_r$ at H=0. The slope of the H—B NIB curve (200) is approximately the permeability of free space, $\mu_0$, in the demagnetization region, that is in the second quadrant (205), due to very low magnetic flux leakage of this class of materials. Note also that the magnetic flux density at the point where the H—B line crosses the gap line, $B_n$, is relatively high.

The effect of an electromagnet with no magnetic material present can be seen by reference to the H—B line for the electromagnet (235). The effect of adding a magnetizing field strength of the electromagnet, $\Delta H_e$, at the zero H and B point results in an added magnetic flux density, $\Delta B_e$, indicated by the shaded triangle (240). The slope of the straight B—H line for the electromagnet (235) is equal to the permeability of free space, $\mu_0$. Thus, the increase in magnetic field of the material when $\Delta H_e$ is applied to the material is given by the equation: $\Delta B_n = \mu_0 \Delta H_e = \Delta B_e$. In other words, for a linear material like NIB (see the B—H NIB curve (200)), the magnetic field due to the electromagnet simply adds to the residual magnetic flux density of the permanent magnet ($B_n$, $H_n$), and ($B_{epn}$, $H_{epn}$) is the new operating point. This is shown by the shaded right triangle (215) with one vertex at the $B_n$, $H_n$ point and another at $B_{epn}$, $H_{epn}$.

The NIB material selected as an example has a residual magnetic flux density, $B_r$, equal to 12.5 kilogauss material, showing that the highest $B_r$ materials are not necessary for a 95 gigahertz second harmonic 18 kilogauss gyrotron magnet. The resulting magnetic flux density of the electropermagnet for this case is raised to 19.3 kilogauss, as shown in FIG. 3, which provides 1.3 kilogauss overhead for compensation of the temperature degradation for NIB and to provide a tuning range capability.

FIG. 3 shows the on-axis magnetic field that has a flat 19.3 kilogauss region at the top part of the plot (310). The flat region is approximately 12 millimeters long, so this electropermagnet could be used for a millimeter-wave gyrotron with a short cavity.

A material with higher residual magnetic flux density, $B_r$, (14~15.0 kilogauss NIB materials are available at this time) could be used to reduce the coil power to about 1 kilowatt for 18 kilogauss.

Figure 4:
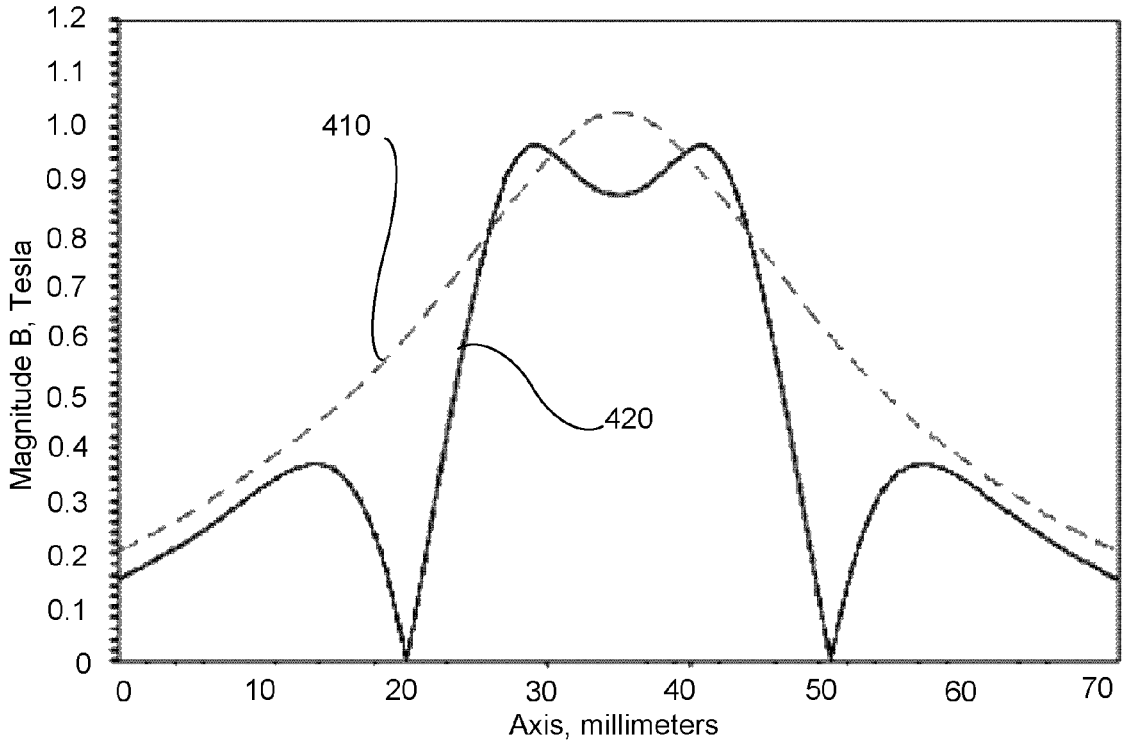
FIG. 4 is a plot of the magnetic flux density of the individual permanent magnet and electromagnet calculated independently.

FIG. 4 plots the on-axis magnitudes of the magnetic flux density of the individual permanent magnet and electromagnet calculated independently. The magnetic field with the electromagnet coil current, $I_{coil}$, equal to zero gives the permanent magnet material magnetic flux density curve (420) without influence of the electromagnet. The sharp dips at 20 millimeter and 50 millimeter positions corresponds to the field reversal points on this magnitude plot, where the field is actually reversing in direction at these points.

An electromagnet magnetic flux density curve (410) results when the electromagnet coil current, in amperes, times the number of turns of wire in that coil equals 42,000 ampere-turns and the NIB material is replaced with air, that is, there is no permanent magnet. This yields a peak magnetic flux density of 1.03 Tesla, which is equal to 10.3 kilogauss.

Note that the permanent magnet material magnetic flux density curve (420) without influence of the electromagnet has a strong dip in the center of the peak, and that the magnitude of magnetic flux density, B, reverses at the ends due to flux that goes around the outside of the magnet. This naturally dipped field of a simple permanent magnet configuration plus the naturally peaked field of the simple electromagnet coil will naturally compensate each other, and can eliminate the magnetic field reversal at the ends.

Permanent magnets acting alone, that is without an electromagnet, would have a magnetic field reversal at two points within the through-bore at the magnetic poles. An energized electromagnet tends to push those points outward to some degree. How much it pushes out depends on the relative strength of the electromagnet and permanent magnet in the through-bore region. If the electromagnet dominates then one or both field reversal points may be pushed out of the through-bore entirely, or even eliminated. Operational performance of the power microwave device is almost universally improved when the field reversal points are outside of the through-bore. Therefore, a preferred embodiment of the invention is structured with an electromagnet having coil of sufficient capacity (turns and current carrying capacity) to move one or both field reversal point out of the through-bore.

In this example used in a gyrotron design, only a very small trim coil (145) was added to the internal diameter of the simple solenoid (electromagnet coil) to make the field very flat in the center. As a matter of practicality, the electromagnet coil would be conveniently used to charge the permanent magnet material after assembly, and then operated as an electropermagnet. This capability adds considerable safety and ease of assembly to the power microwave tube assembly process.

Regarding the second case of a nonlinear material for the permanent magnet, the H—B Alnico5 curve (225) shows a residual magnetic flux density, $B_r$, of 1.27 Tesla at the point where the H—B Alnico5 curve (225) crosses the H=0 line.

Figure 5:
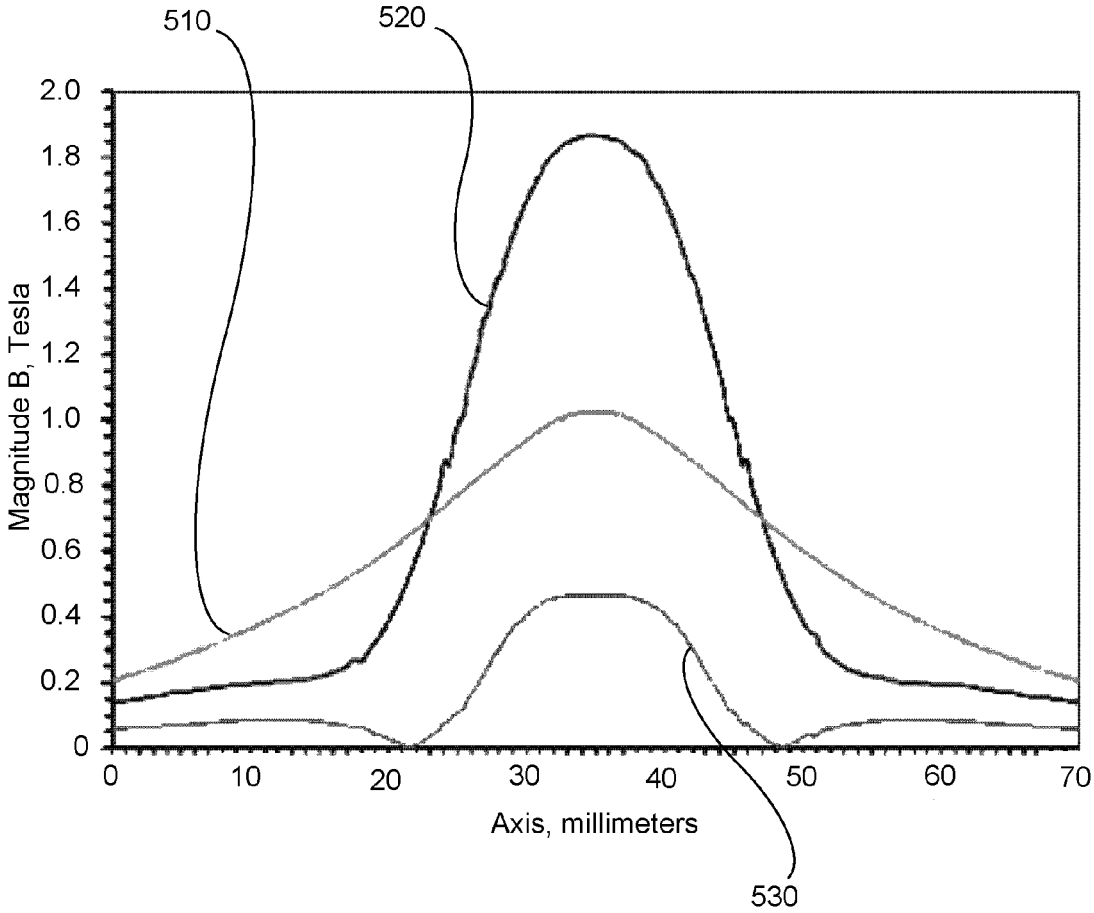
FIG. 5 is plot of the magnetic flux densities of an electropermagnet with a highly non-linear magnetic permanent magnet material, its individual permanent magnet and its electromagnet, each calculated independently.

FIG. 5 plots the calculated magnetic flux densities in the air gap of three components: the Alnico5 permanent magnet curve (530), which is the lowest curve based on a zero coil current; the electromagnet curve (510) with no permanent magnet present; and the electropermagnet curve (520), which results from their combination in the configuration of the invention.

FIG. 5 shows that with a zero coil current, the magnetic flux density, B, in the air gap drops to 0.47 Tesla. This is for the Alnico5 permanent magnet curve (530), i.e., the lowest curve on the plot. This low magnetic flux density is attributable to the low coercivity of the Alnico5 material. In comparison, this is only about half of the field of the identical geometry with the NIB material.

The field from the electromagnet alone (the electromagnet curve (510) is the middle curve with 1.03 Tesla peak field.

However, when the same electromagnet coil current of 42,000 ampere-turns as was used for the NIB material, is applied with Alnico5 material, it is found that the peak field rises to 1.87 Tesla, or nearly as much added magnetic flux density as was added when using the NIB material with a coercivity of about 18 times higher than Alnico5. (In this example, there was no effort made to flatten the field in the center, just a straight substitution of Alnico5 for the NIB.) Thus, there is a bonus of an extra 0.37 Tesla in the air gap with using the same coil current (and power).

This second case is qualitatively understood by reference to FIG. 2 for the nonlinear material at the intersection of the air gap line (210) with the Alnico5 curve (225), which intersects at low value ($B_a$, $H_a$). If the same change in magnetic field strength, $\Delta H_e$, is applied from the electromagnet as was applied in the above first case example for NIB, then the resulting change in the Alnico5 magnetic flux density, $\Delta B_a$ is greater than the resulting change in the NIB magnetic flux density, $\Delta B_n$. The change is shown in the shaded box (230) under the Alnico5 curve (225). The point $B_{epa}$, $H_{epa}$ on the Alnico5 curve (225) is the new operating point.

A significant conclusion is that air gaps larger than those that can be supported efficiently by a low coercive material, can be supported efficiently by an electropermagnet, and significantly smaller magnets for a given geometry of air gap and field can result. This is a phenomenon attributable to the electropermagnet.

A physical explanation of this phenomenon is as follows. When an air gap is inserted into an otherwise closed loop of a magnetic circuit of the magnetized (and saturated) nonlinear material, there is an effective demagnetization force due to the gap geometry and self-demagnetization due to large flux leakage (flux leaving the material outside of the air gap). This flux leakage is most pronounced in the vicinity of the air gap, and the material in this region is no longer saturated and has a permeability of greater than that of free space, i.e. $\mu>\mu_0$ (e.g., $\mu/\mu_0=\mu_r\sim25$ in the example geometry). When an electromagnet coil is placed around, or near, the material and air gap, the flux is forced to flow in the material, thereby reducing the flux leakage loss and returning the material to a saturated state. This is equivalent to inserting saturating pole pieces into the ends of an electromagnet to enhance the field in the center of an electromagnet, but in the case of the electropermagnet the pole pieces are also magnetized. Simulation of the complete magnet using thousands of cells/points is required to accurately obtain the overall result.

As a final non-limiting example of the potential of the invention, it is practical to obtain electromagnet solenoid direct current fields of about 12 kilogauss in a 1-centimeter inside-diameter through-bore at manageable power levels of approximately 1.6 kilowatts per centimeter of bore length. Typical cavity lengths are about 1 to 3 centimeters long for most millimeter wave (e.g. 95 gigahertz) gyrotrons. Currently available permanent magnet materials (with a residual magnetic flux density, $B_r$, equal to 15 kilogauss material) can produce a useful air gap field of at least 12 kilogauss. Therefore, direct current operating electropermagnets have potential to realize up to at least 24 kilogauss with through-bores of sufficient size for a gyrotron with currently available materials. An electropermagnet similar to FIG. 1 with a residual magnetic flux density, $B_r$, equal to 15 kilogauss material and operating at 18 kilogauss would consume only about 1 kilowatt of direct current power compared to about 30 kilowatts of direct current power for an 18 kilogauss electromagnet that would have to be about 8 centimeters long to produce a similar 18 kilogauss region.

In addition, the electromagnet coil of the electropermagnet can be pulsed to further increase the magnetic field in the air gap and reduce the average power consumed by the coil to less than the average power that would be consumed by a pulsed electromagnet operating at the same duty.

The electropermagnet eliminates demagnetizing problems associated with the use of magnetic materials in the electropermagnet even when the coil is pulsed to very high magnetization force because the magnetized material is operated in the magnetizing quadrant, that is the first quadrant (220), and high or low coercive force materials can be utilized.

A method of providing a magnetic field in a power microwave generator includes steps of combining a permanent magnet with an electromagnet in accordance with the electropermagnet device of the invention and energizing the electromagnetic coil. An alternative embodiment includes a step wherein energizing the electromagnetic coil is by pulsing the coil current to periodically increase and decrease the magnetic field.

The above-described embodiments including the drawings are examples of the invention and merely provide illustrations of the invention. Other embodiments will be obvious to those skilled in the art. Thus, the scope of the invention is determined by the appended claims and their legal equivalents rather than by the examples given.

What is claimed is:

1. A magnet configuration for a power microwave tube to produce a very high magnetic flux density within a resonant cavity comprising:

a solid permanent magnet configured to define an approximately centered through-bore along its axis, wherein the through-bore is of sufficient size to contain the resonant cavity, wherein the permanent magnet has an inner chamber centered on said axis and wherein the inner chamber wall at opposing ends of the axis forms opposite magnetic poles; and, an electromagnet coil fitting in said inner chamber and encircling the axis such that when electrically energized said coil produces a magnetic field that reinforces the magnetic field from the permanent magnet.

2. The magnet configuration of claim 1 wherein the permanent magnet has a circumferential protrusion spanning the through-bore and extending from the wall of the chamber.

3. The magnet configuration of claim 1 wherein the permanent magnet is in the shape of a right circular cylinder.

4. The magnet configuration of claim 1 wherein the inner chamber has approximately a rectangular cross-sectional shape.

5. The magnet configuration of claim 1 wherein the through-bore has a diameter up to about 25 millimeters.

6. The magnet configuration of claim 1 wherein the outside diameter of the permanent magnet is up to about 30 centimeters.

7. The magnet configuration of claim 1 wherein the length of the permanent magnet along its axis is up to about 30 centimeters.

8. The magnet configuration of claim 1 that produces a peak through-bore magnetic flux density up to about 24 kilogauss.

9. The magnet configuration of claim 1 wherein the permanent magnet comprises a material having a property selected from a group consisting of high coercive force, low coercive force, linear, and non-linear.

10. The magnet configuration of claim 1 further comprising a trim coil.

11. The magnet configuration of claim 1 wherein the electromagnet has a coil of sufficient capacity to move a magnetic field reversal point out of the through-bore.

12. The method of providing a magnetic field in a power microwave generator comprising the steps of:

(a) combining a permanent magnet with an electromagnet in accordance with the magnet configuration of claim 1; and, (b) energizing the electromagnetic coil.

13. The method of claim 12 wherein the step of energizing the electromagnetic coil is performed by pulsing the coil current to periodically increase and decrease the magnetic field.

* * * * *